US008789712B2

(12) United States Patent
Johnson et al.

(10) Patent No.: US 8,789,712 B2
(45) Date of Patent: Jul. 29, 2014

(54) LOOSE ITEM DISPLAY FIXTURE

(75) Inventors: Jason W. Johnson, Wayzata, MN (US); Timothy J. Martell, Brooklyn Park, MN (US); Daniel J. Noll, Madison, WI (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/535,634

(22) Filed: Jun. 28, 2012

(65) Prior Publication Data

US 2014/0001131 A1 Jan. 2, 2014

(51) Int. Cl.
*A47G 29/00* (2006.01)

(52) U.S. Cl.
USPC ..... 211/71.01; 211/85.18; 211/94.01

(58) Field of Classification Search
USPC ..... 211/71.01, 85.18, 85.19, 85.21, 85.23, 211/89.01, 94.01; 248/312, 312.1, 315
See application file for complete search history.

(56) References Cited

U.S. PATENT DOCUMENTS

| | | | | | |
|---|---|---|---|---|---|
| 328,926 | A | | 10/1885 | Elliott | |
| 928,213 | A | | 7/1909 | Patterson | |
| 1,001,416 | A | | 8/1911 | Lloyd | |
| 1,112,558 | A | | 10/1914 | Red | |
| 1,157,333 | A | * | 10/1915 | Snell | 248/291.1 |
| 1,989,294 | A | | 1/1935 | Serpico | |
| 2,711,873 | A | | 6/1955 | Larin | |
| 2,763,377 | A | | 9/1956 | Martin | |
| 3,711,048 | A | | 1/1973 | Thalenfeld | |
| 3,870,154 | A | | 3/1975 | Monet et al. | |
| 3,921,948 | A | | 11/1975 | Long | |
| 4,011,951 | A | * | 3/1977 | Boyer | 211/85.21 |
| 4,187,948 | A | * | 2/1980 | Perrella | 211/85.17 |
| 4,679,695 | A | | 7/1987 | Leff | |
| D306,805 | S | | 3/1990 | Larson et al. | |
| 5,009,380 | A | * | 4/1991 | Fee | 248/214 |
| 5,054,738 | A | * | 10/1991 | Harding | 248/538 |
| 5,090,587 | A | * | 2/1992 | Brown | 220/475 |
| 5,215,200 | A | | 6/1993 | Rosenthal | |
| 5,224,609 | A | | 7/1993 | Bauer et al. | |
| D338,122 | S | | 8/1993 | Emalfarb et al. | |
| 5,318,187 | A | * | 6/1994 | Rosenthal | 211/88.01 |

(Continued)

OTHER PUBLICATIONS

Office Action from Canadian Patent Application No. 2,794,713, mailed Mar. 1, 2013 (3 pages).

(Continued)

*Primary Examiner* — Korie H Chan
(74) *Attorney, Agent, or Firm* — Griffiths & Seaton PLLC; JoAnn M. Seaton

(57) ABSTRACT

A display fixture includes a support assembly mounted to a pair of uprights on a display unit and has a pair of arms having upper surfaces that directly attach to the uprights and a crossbar extending between proximal ends of the pair of arms. The upper surfaces are oriented at a first angle from the uprights. The display fixture also includes at least one loose item display assembly mounted to the crossbar and includes a collar and a mounting bracket. The collar has an inner diameter that defines a central opening for receiving a container. The mounting bracket is fixedly attached to a back of the collar at a proximal end and removably coupled to the crossbar of the support assembly with a distal clip. An upper surface of the collar is oriented at a second angle relative to upper surfaces of the pair of arms of the support assembly.

18 Claims, 7 Drawing Sheets

(56) References Cited

U.S. PATENT DOCUMENTS

| | | | | |
|---|---|---|---|---|
| 5,687,856 | A * | 11/1997 | Kendrena | 211/70.6 |
| D400,030 | S | 10/1998 | Wetzel | |
| D446,051 | S | 8/2001 | Gasmi | |
| D451,704 | S | 12/2001 | Curci | |
| D453,447 | S | 2/2002 | Bi | |
| 6,412,741 | B1 * | 7/2002 | Olivero | 248/313 |
| 6,607,088 | B2 * | 8/2003 | Cestrone | 220/23.86 |
| D479,060 | S | 9/2003 | Wetzel | |
| 6,783,021 | B2 * | 8/2004 | Kaura | 220/482 |
| 7,014,280 | B2 | 3/2006 | Borgen et al. | |
| 7,017,759 | B1 | 3/2006 | Friend | |
| 7,124,898 | B2 | 10/2006 | Richter et al. | |
| D534,013 | S | 12/2006 | Jahnke | |
| D548,526 | S | 8/2007 | Huffman et al. | |
| D557,072 | S | 12/2007 | Lim | |
| D580,193 | S | 11/2008 | Sparkowski | |
| D587,523 | S | 3/2009 | Moon | |
| 7,530,329 | B1 * | 5/2009 | Paris et al. | 119/61.57 |
| 7,637,575 | B2 * | 12/2009 | Amari et al. | 312/116 |
| 7,665,618 | B2 | 2/2010 | Jay et al. | |
| D631,679 | S | 2/2011 | Woelfel | |
| D637,421 | S | 5/2011 | Theisen et al. | |
| D640,094 | S | 6/2011 | Carlson et al. | |
| D642,863 | S | 8/2011 | Tobias | |
| D655,573 | S | 3/2012 | O'Connor | |
| 2004/0154498 | A1 | 8/2004 | Borgen et al. | |
| 2006/0043038 | A1 * | 3/2006 | Wetzel et al. | 211/88.03 |
| 2007/0175843 | A1 * | 8/2007 | Kanasashi et al. | 211/94.01 |

OTHER PUBLICATIONS

Pending U.S. Appl. No. 29/425,894, filed Jun. 28, 2012, entitled Display Fixture, 10 pages.

* cited by examiner

LOOSE ITEM DISPLAY FIXTURE

BACKGROUND

A retail establishment uses various types of display units to organize and present products or merchandise to customers for purchase. One kind of display unit is a gondola. Gondola display units are constructed of, but are not limited to, uprights, back panels, base decks and kick plates. Gondola display units act as base units for supporting display fixtures for displaying products. For example, a gondola display unit can support a shelf that displays products while simultaneously providing space for indicating a product price.

The discussion above is merely provided for general background information and is not intended to be used as an aid in determining the scope of the claimed subject matter.

SUMMARY

A display fixture includes a support assembly mounted to a pair of uprights on a display unit and including a pair of arms and a crossbar. Distal ends of the pair of arms directly attach to the uprights on the display unit and the crossbar extends between proximal ends of the pair of arms. At least one loose item display assembly is mounted to the crossbar of the support assembly. Each of the loose item display assemblies include a collar having an inner diameter that defines a central opening and a mounting bracket fixedly attached to a back of the collar at a proximal end and removably coupled to the crossbar of the support assembly with a distal clip. The central opening of the collar receives and retains a container for holding loose items for display. Upper surfaces of the pair of arms of the support assembly are oriented at a first angle relative to the pair of uprights and an upper surface of the collar is oriented at a second angle relative to the upper surfaces of the pair of arms The first angle is different from the second angle.

In one embodiment, the support assembly is an upper support assembly, the pair of arms is a pair of upper arms and the crossbar is an upper crossbar. In such an embodiment, the display fixture further includes a lower support assembly mounted to the pair of uprights on the gondola display unit below the upper support assembly and includes a pair of lower arms and a lower crossbar. Distal ends of the pair of lower arms directly attach to the uprights on the gondola display unit and the lower crossbar extends between proximal ends of the pair of lower arms.

The container of the at least one loose item display assembly supports loose items and includes a main body having a first outer diameter and an upper body having a second outer diameter that is greater than the first outer diameter of the main body such that a space between the first outer diameter of the main body and the second diameter of the upper body forms a peripheral shoulder. The collar of the at least one loose item display assembly that is removably coupled to the support assembly by the mounting bracket is configured to receive the container such that the peripheral shoulder of the container rests on an upper surface of the collar.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a display fixture for mounting to a display unit, such as a gondola display unit, located in a retail store. The display fixture includes an upper crossbar, a lower crossbar, a plurality of collars and a plurality of receptacles. Each of the collars mounts to one of the crossbars and receives one of the receptacles, which holds loose items for display. For example, the receptacles can hold stemmed natural or artificial flowers and the like.

Figure 1:
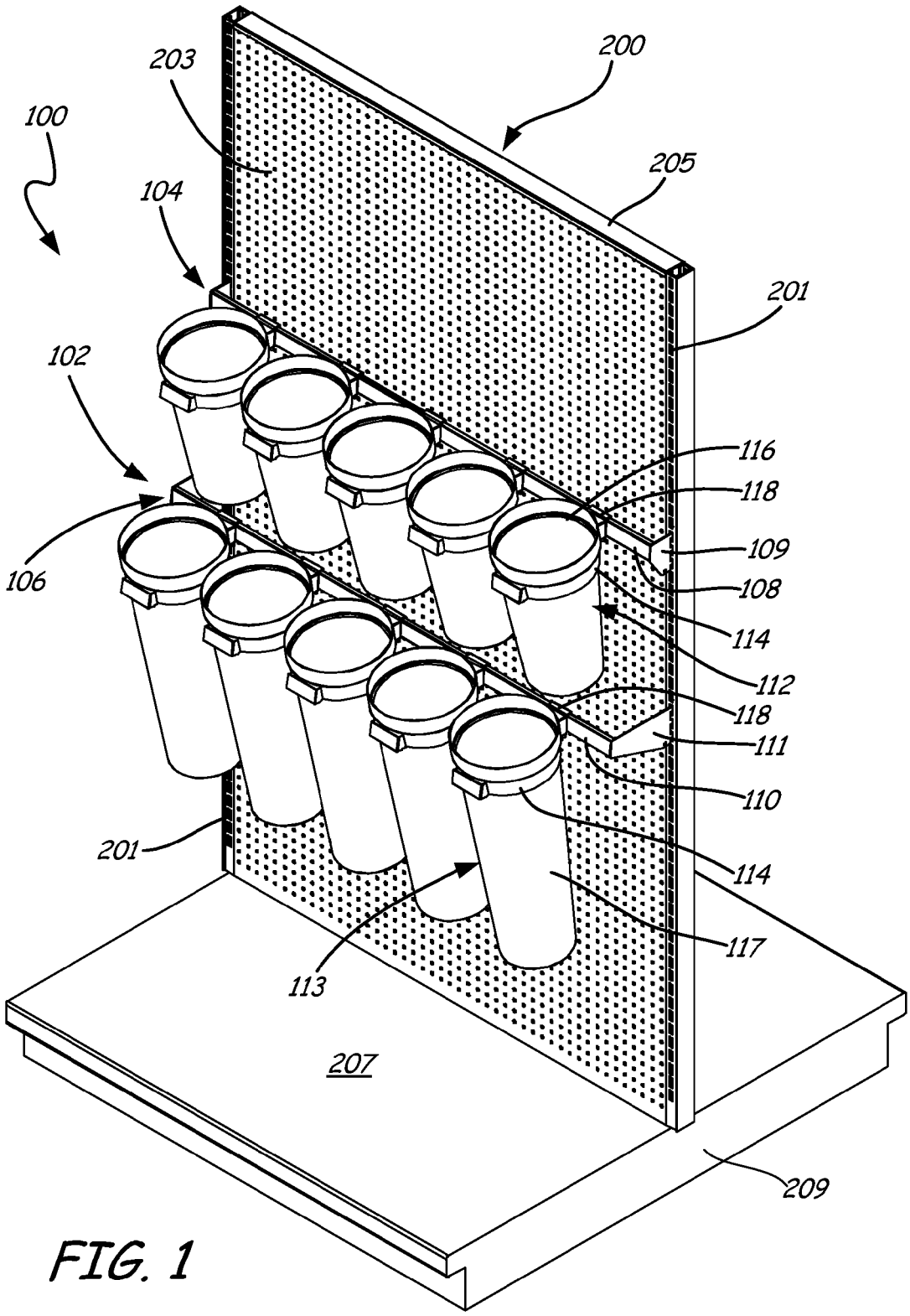
FIG. 1 is a perspective view of a display fixture mounted to a display unit according to one embodiment.

FIG. 1 is a perspective view of a display fixture 100 mounted to a display unit 200 according to one embodiment. Display unit 200 is an exemplary gondola display unit as used in retail stores for holding products for sale. These types of display units can be wall mounted or free-standing. As illustrated in FIG. 1, exemplary display unit 200 is free-standing and includes a pair of uprights 201, a back panel 203, a top rail 205, a base deck 207 and base ends 209. Hidden from view are a pair of base brackets that along with the uprights 201 provide the main support structure for display unit 200. In a retail store, display unit 200 can be positioned adjacent to other gondola display units to define one side of an aisle.

Display fixture 100 includes a support assembly 102 having an upper support assembly 104 and a lower support assembly 106. Upper support assembly 104 includes an upper crossbar or upper horizontal member 108 and a pair of upper arms or struts 109 and lower support assembly 106 includes a lower crossbar or lower horizontal member 110 and a pair of lower arms or struts 111. Display fixture 100 also includes at least one loose item display assembly 112 mounted to crossbar 108 of upper support assembly 104 and having a collar or ring 114, a container or receptacle 116 and a mounting bracket 118. Display fixture 100 also includes at least one loose item display assembly 113 mounted to crossbar 110 of lower support assembly 106 and having the same collar or ring 114 as loose item display assembly 112, a container or receptacle 117 and the same mounting bracket 118 as loose item display assembly 112. Container or receptacle 117 is substantially conical in shape.

Figure 2:
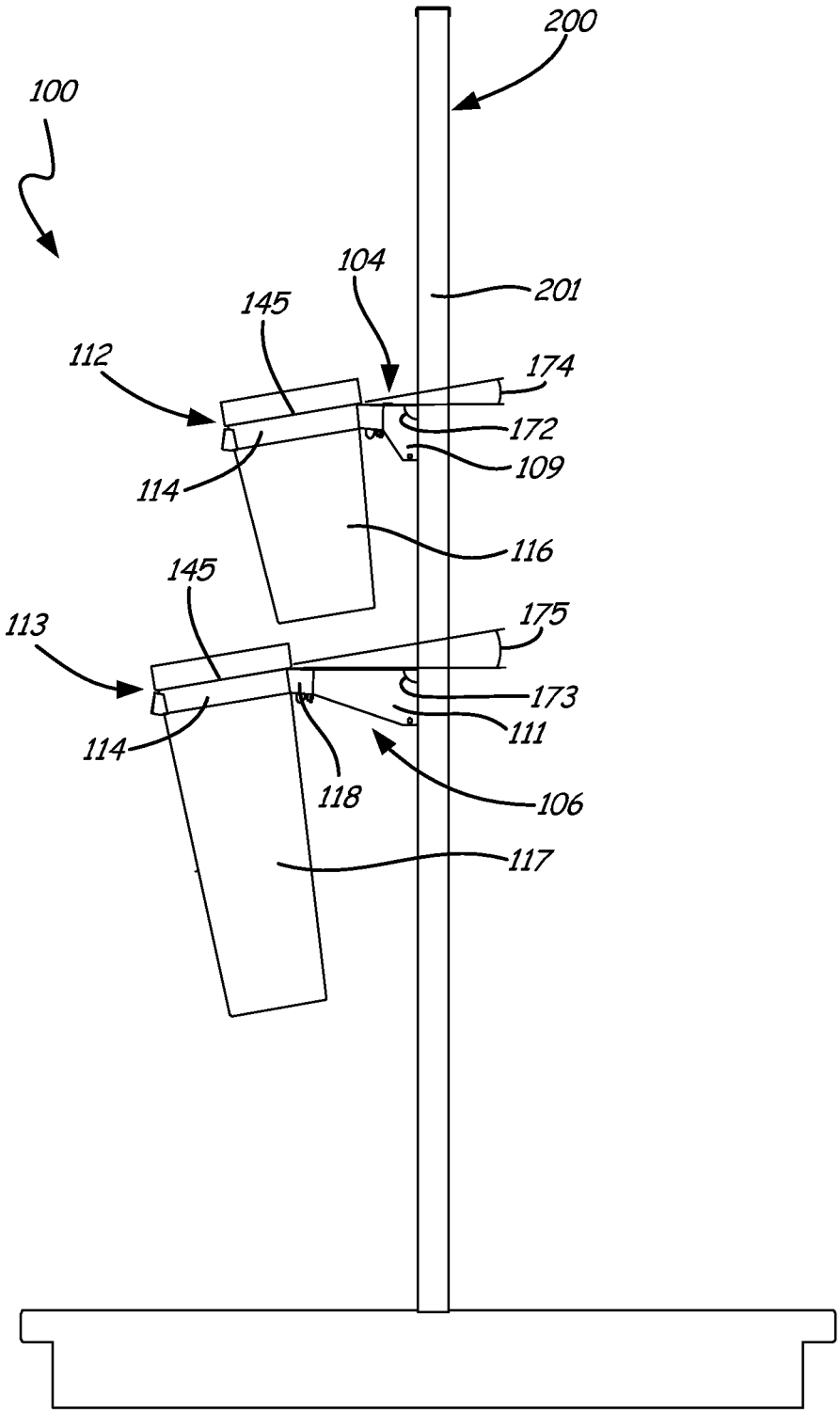
FIG. 2 is a side profile view of FIG. 1.

FIG. 2 is a side profile view of display fixture 100 mounted to display unit 200. As illustrated in FIG. 2, the tiered arrangement of loose item display assemblies 112 and 113 is made possible by the different distances that upper crossbar 108 and lower crossbar 110 are cantilevered from the pair of uprights 201 of display unit 200 as well as the angle at which the containers or receptacles 116 and 117 are angled from the back panel 203 of gondola display unit 200.

Figure 3:
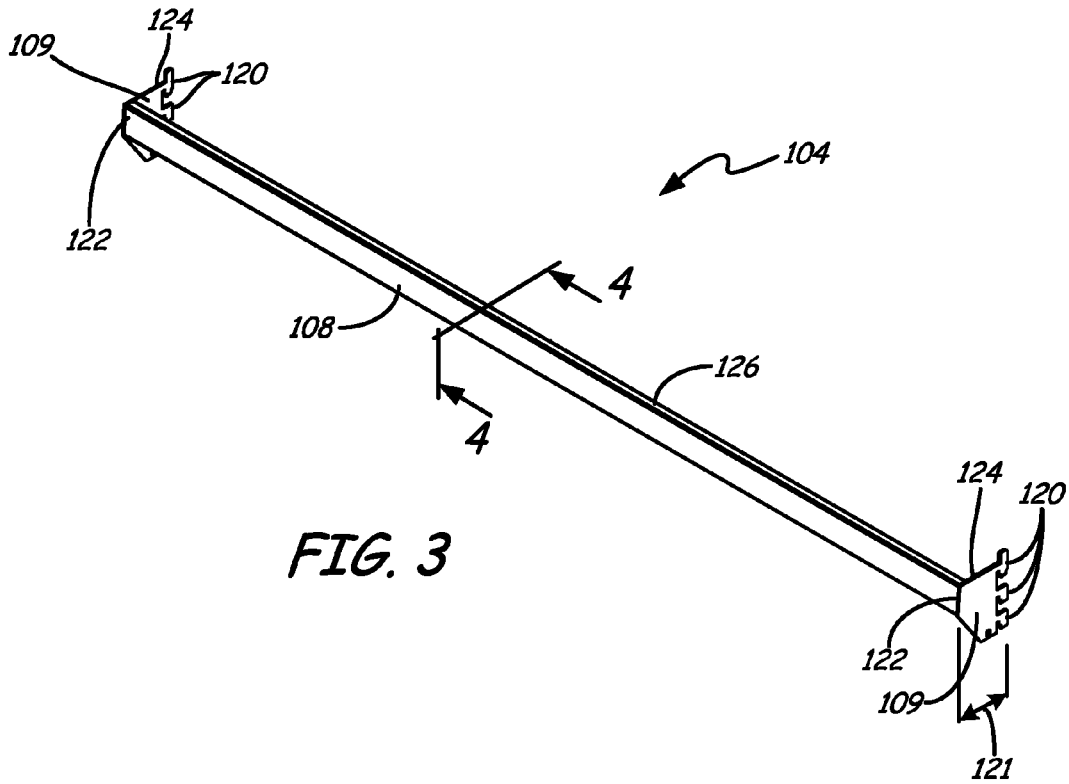
FIG. 3 illustrates a perspective view of an upper support assembly of the display fixture of FIG. 1.
Figure 4:
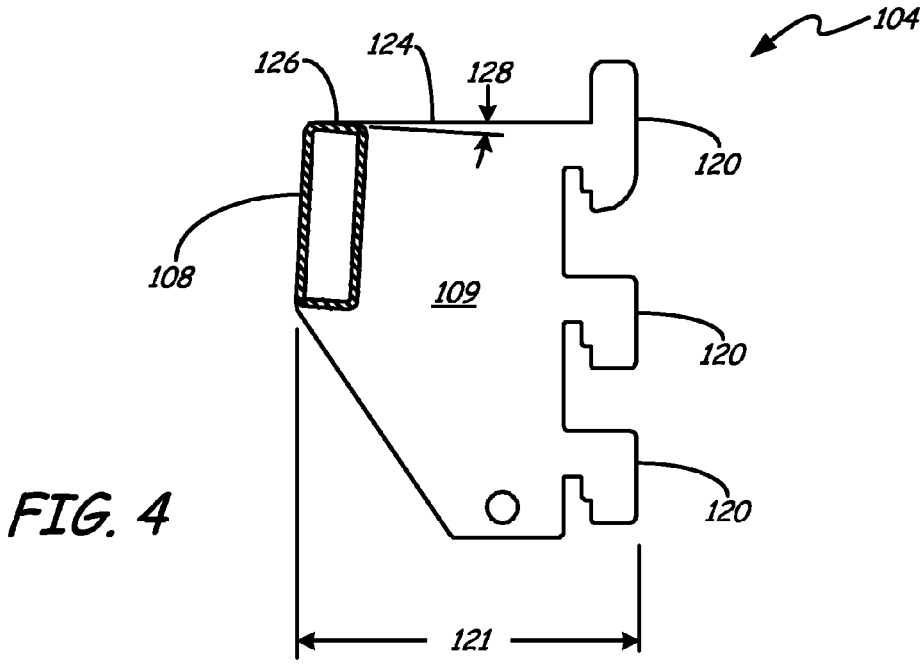
FIG. 4 illustrates a sectional view of the upper support assembly of FIG. 3.

FIG. 3 illustrates a perspective view of upper support assembly 104 and FIG. 4 is an enlarged section view of upper support assembly 104. Distal ends 120 of the pair of upper arms or struts 109 are configured to directly attach to the uprights (i.e., uprights 201) on a display unit. Each of the pair of upper arms 109 extend a first distance 121 between distal ends 120 and proximal ends 122 so that when distal ends 120 are directly attached to the uprights on the display unit, upper crossbar 108 is cantilevered from the back panel of the display unit by a distance that is substantially similar to distance 121. Each of the pair of upper arms 109 also includes an upper surface 124.

Upper crossbar or upper support member 108 extends between proximal ends 122 of the pair of upper arms or struts 109. The upper crossbar 108 includes an upper surface 126. As clearly illustrated in FIG. 4, upper surface 126 of upper crossbar 108 is oriented at an angle 128 relative to upper surfaces 124 of the pair of upper arms 109. For example, angle 128 can range between approximately 1 and 5 degrees. More specifically, and in one embodiment, angle 128 can be approximately 3 degrees.

Figure 5:
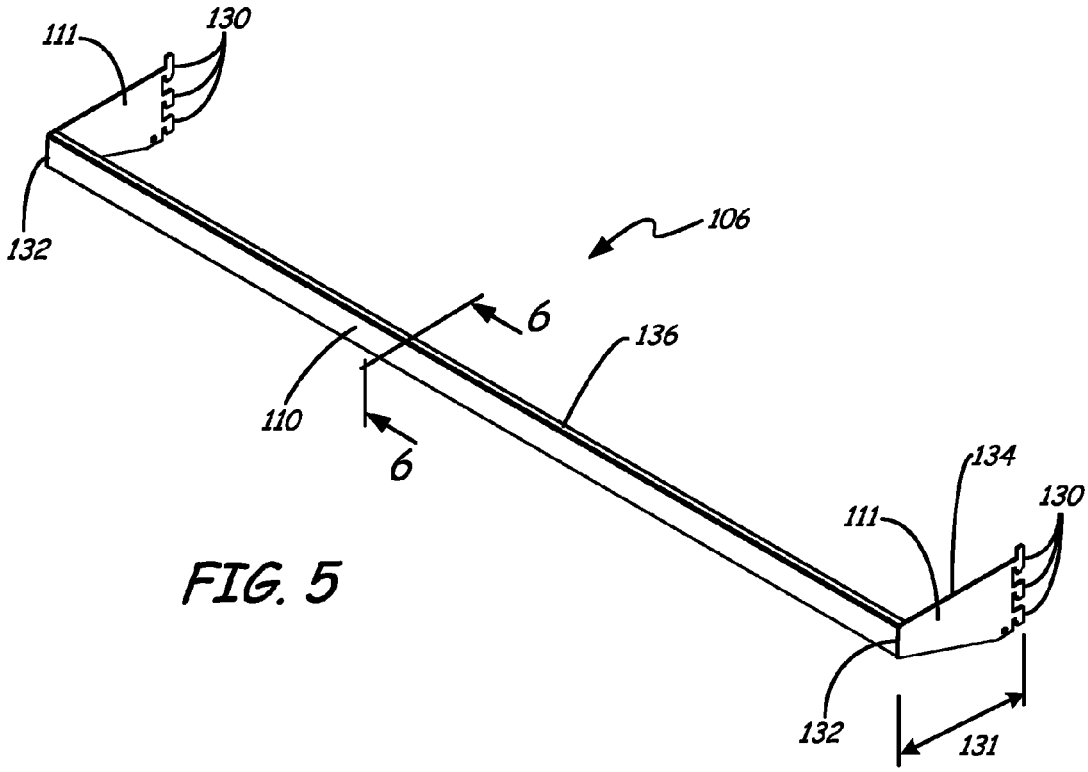
FIG. 5 illustrates a perspective view of a lower support assembly of the display fixture of FIG. 1.
Figure 6:
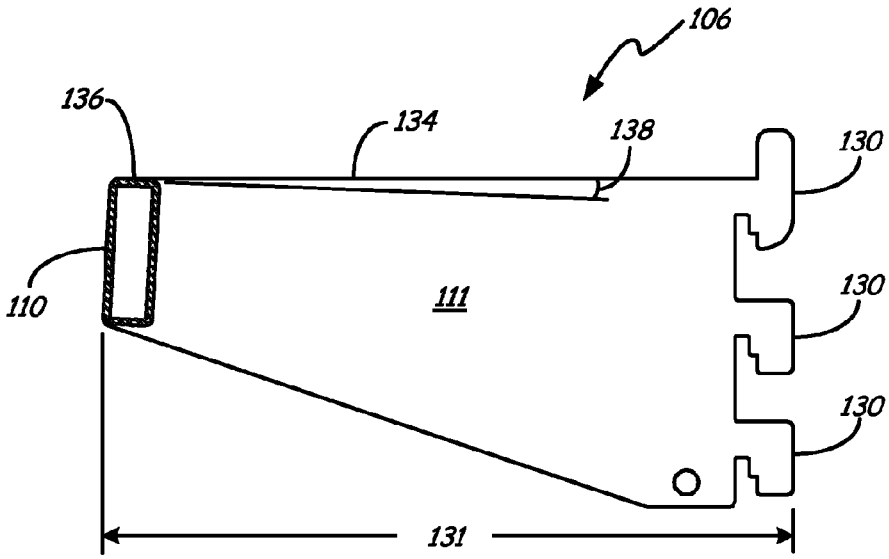
FIG. 6 illustrates a sectional view of the lower support assembly of FIG. 5.

FIG. 5 illustrates a perspective view of lower support assembly 106 and FIG. 6 is an enlarged section view of lower support assembly 106. Distal ends 130 of the pair of lower arms or struts 111 of lower support assembly 106 are configured to directly attach to the uprights (i.e., uprights 201) on a display unit. Each of the pair of lower arms 111 extend a second distance 131 between distal ends 130 and proximal ends 132 so that when distal ends 130 are directly attached to the uprights on the display unit, lower crossbar 110 is cantilevered from the back panel of the display unit by a distance that is substantially similar to second distance 131. Each of the pair of lower arms 111 also includes an upper surface 134.

Lower crossbar or lower support member 110 extends between proximal ends 132 of the pair of lower arms or struts 111. The lower crossbar 110 includes an upper surface 136. As clearly illustrated in FIG. 6, upper surface 136 of lower crossbar 110 is oriented at an angle 138 from upper surface 134 of the pair of lower arms 111. For example, angle 138 can range between approximately 1 and 5 degrees. More specifically, and in one embodiment, angle 138 can be approximately 3 degrees. More specifically, angle 128 between upper surface 126 of upper crossbar 108 and upper surfaces 124 of the pair of upper arms 109 is substantially identical to angle 138.

Figure 7:
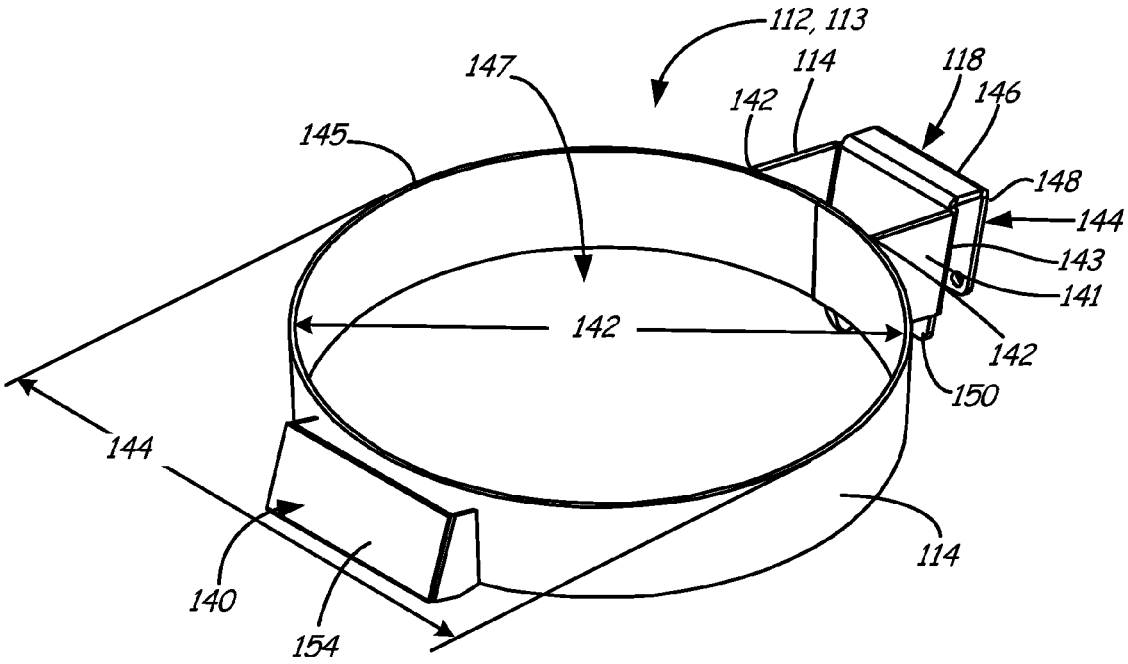
FIG. 7 illustrates one of the collars of the display fixture of FIG. 1.
Figure 8:
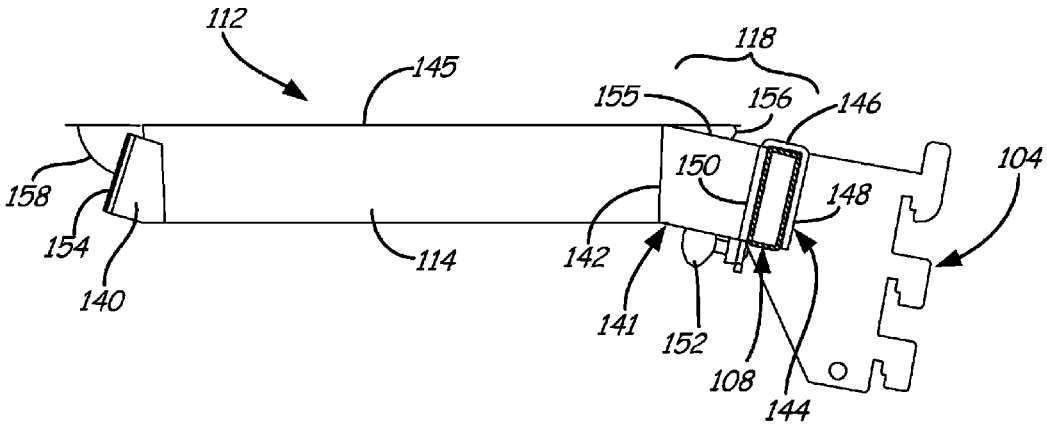
FIG. 8 illustrates a side profile view of the collar of FIG. 7 mounted on an upper support assembly shown in section.
Figure 9:
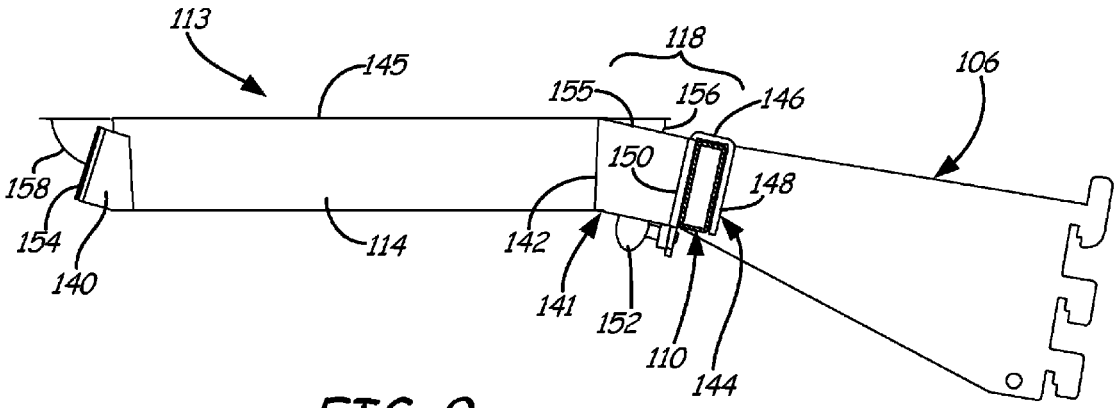
FIG. 9 illustrates a side profile view of the collar of FIG. 7 mounted on a lower support assembly shown in section.

FIG. 7 illustrates a perspective view of one of the loose item display assemblies 112 or 113 (with its container or receptacle 116 or 117 removed for clarity). FIG. 8 illustrates an elevation view of loose item display assembly 112 (with its container or receptacle 116 removed for clarity). In FIG. 8, upper support assembly 104 is shown in section like FIG. 4 to illustrate the exemplary embodiment of loose item display assembly 112 mounted to upper support assembly 104. FIG. 9 illustrates an elevation view of one of the loose item display assemblies 113 (with its container or receptacle 117 removed for clarity). In FIG. 9, lower support assembly 106 is shown in section like FIG. 6 to illustrate the exemplary embodiment of loose item display assembly 113 mounted to lower support assembly 106.

In FIGS. 7, 8 and 9, loose item display assemblies 112 and 113 include a collar or ring 114, mounting bracket 118 and a sign holder 140. Collar 114 includes an inner diameter 142, an outer diameter 144 and an upper surface 145. Inner diameter 142 defines a central opening 147 of collar 114 that is configured to receive and retain a container or receptacle (i.e., container 116 or 117 illustrated in FIGS. 1, 2, 10 and 11) for holding loose items for display. Mounting bracket 118 of both loose item display assembly 112 and 113 is fixedly attached to a back of collar 114 and removably coupled to a crossbar, such as upper crossbar 108 (FIG. 8) or lower crossbar 110 (FIG. 9), with a distal clip 144.

In particular, mounting bracket 118 includes at least one member 141 fixedly attached to the back of collar 114 at proximal ends 142. Coupled to a distal end 143 of member 141 is distal clip 144. Distal clip 144 includes a saddle 146 extending between a distal downwardly depending clip member 148 and a proximal downwardly depending clip member 150. As illustrated in FIGS. 8 and 9, saddle 146 contacts or engages with upper surface 126 of upper crossbar 108 or upper surface 136 of lower crossbar 110. As also illustrated in FIGS. 8 and 9, a fastener 152 is inserted through proximal downwardly depending clip member 150 to provide further structural stability to the engagement between distal clip 144 and upper support assembly 104 or lower support assembly 102. In accordance with one embodiment, fastener 152 is a thumbscrew or threaded post that screws into and through a hole in clip member 150 such that an end of the threaded post extends underneath upper crossbar 108 or lower crossbar 110 into an engagement position. In the engagement position, fastener 152 prevents distal clip 144 from being pushed up and off the upper crossbar 108 or the lower crossbar 110. In FIGS. 8 and 9, fastener 152 is not in an engagement position. Rather, in FIGS. 8 and 9, fastener 152 is disengaged. To engage fastener 152, the end of the threaded post needs to be positioned below upper crossbar 108 or lower crossbar 110 by rotating or threading fastener 152 into downwardly depending clip member 150.

Sign holder 140 directly attaches to a front of collar 114 and includes a front face 154. Front face 154 is configured to receive and retain a marketing sign. In particular, front face 154 is configured to receive and retain a marketing sign that is indicative of product price for the loose items being held by loose item display assembly 112 or 113.

As illustrated in FIGS. 1 and 2, various components of loose item display assemblies 112 and 113 are oriented at different relative angles in order to provide display fixture with a tiered arrangement. In particular and with reference to FIGS. 8 and 9, upper surface 145 of collar 114 for both loose item display assembly 112 and loose item display assembly 113 is oriented at an angle 156 relative to an upper surface 155 of member 141. For example, angle 156 can range between approximately 5 and 20 degrees. More specifically, and in one embodiment, angle 156 can be approximately 10 degrees. Further, front face 154 of sign holder 140 is oriented at an angle 158 relative to upper surface 145 of collar 114. For example, angle 158 can range between 60 and 80 degrees. More specifically, and in one embodiment, angle 158 can be approximately 70 degrees.

Figure 10:
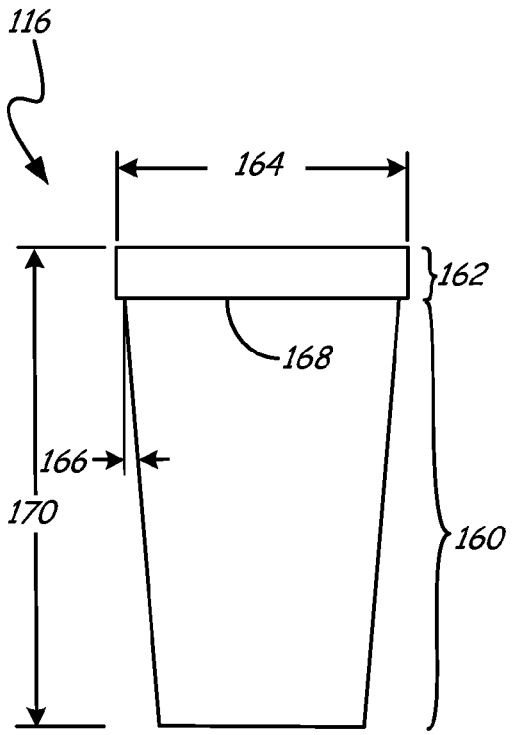
FIG. 10 is an elevation view of one embodiment of a container of the display fixture of FIG. 1.
Figure 11:
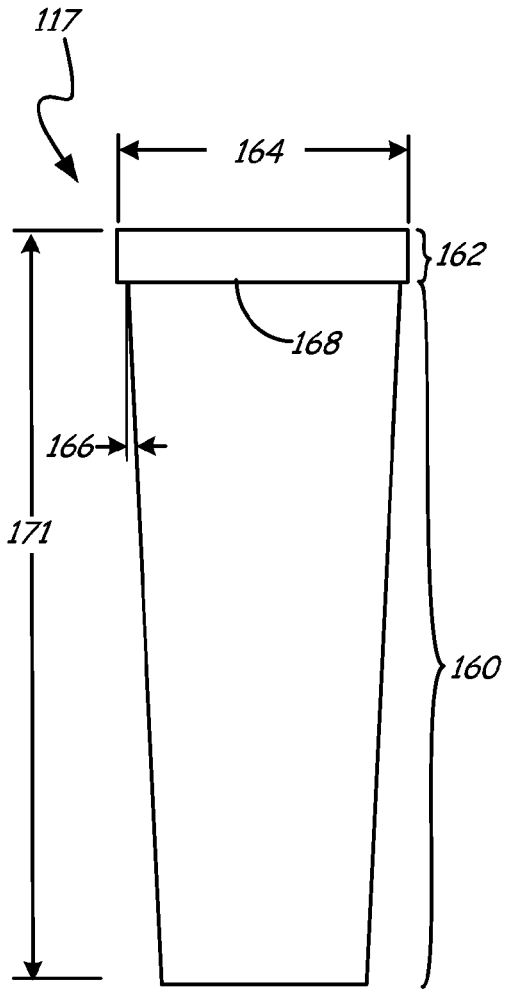
FIG. 11 is an elevation view of another embodiment of a container of the display fixture of FIG. 1.

FIG. 10 illustrates an elevation view of one container or receptacle 116 for one of the loose item display assemblies 112 that are mounted to upper support assembly 104. FIG. 11 illustrates an elevation view of one container or receptacle 117 for one of the loose item display assemblies 113 that are mounted to lower support assembly 106. Containers 116 and 117 include a main body 160 and an upper body 162. Main body 160 includes a first outer diameter 164 and upper body 162 includes a second outer diameter 166. First outer diameter 164 is continuous along the entire upper body 162, while second outer diameter 166 is the maximum diameter of main body 160 with the remainder of the diameter of main body 160 tapering to a minimum diameter. First outer diameter 164 is greater than second outer diameter 166 such that a space between first outer diameter 164 and second outer diameter 166 forms a peripheral shoulder 168. The main difference between container 116 and container 117 is a container height. Container 116 includes a container height 170 that is less than a container height 171 of container 117.

Each collar 114 of each loose item display assembly 112 that is mounted to upper support assembly 104 is configured to receive one of the containers or receptacles 116 that have container height 170. Each collar 114 of each loose item display assembly 113 that is mounted to lower support assembly 106 is configured to receive one of the container or receptacles 117 that have container height 171. Therefore, the smaller containers 116 are positioned above the larger containers 117. Containers 116 and containers 117 are retained by collars 114 by upper surface 145 of each collar 114 engaging with a peripheral shoulder 168. In other words, peripheral shoulder 168 rests on upper surface 145 of each collar 114 of loose item display assembly 112 or loose item display assembly 113. However, it should be realized that any height size of receptacle or container can be received and retained by each collar 114 of loose item display assemblies 112 and 113. For example, larger containers can be positioned above the smaller containers or a variation of sizes of containers can be placed in different loose item display assemblies regardless if the loose item display assembly is mounted to upper crossbar 108 or lower crossbar 110.

When loose item display assemblies 112 are mounted to upper support assembly 104, which is mounted to uprights 201 of display unit 200 (illustrated in FIGS. 1 and 2) and loose item display assemblies 113 are mounted to lower support assembly 106 (illustrated in FIGS. 1 and 2), various components of the loose item display assemblies 112 and 113 are oriented at different relative angles to upper support assembly 104 and lower support assembly 106 and various components of upper support assembly 104 and lower support assembly 106 are oriented at different relative angles to uprights 201 or back panel 203 of display unit 200 in order to provide display fixture with a tiered arrangement.

In particular, upper surfaces 124 of the pair of upper arms or struts 109 are oriented at an angle 172 relative to the pair of uprights 201 or back panel 203 and upper surfaces 134 of the pair of lower arms or struts 111 are oriented at an angle 173 relative to the pair of uprights 201 or back panel 203. For example, angles 172 and 173 can range between 80 and 100 degrees. More specifically, and in one embodiment, angles 172 and 173 are substantially identical and can be approximately 90 degrees. In addition, upper surfaces 145 of collars 114 are oriented at an angle 174 relative to upper surfaces 124 of the pair of upper arms or struts 109 when collars 114 are mounted to the upper support assembly 104 and upper surfaces 145 of collars 114 are oriented at an angle 175 from upper surfaces 134 of the pair of lower arms or struts 111 when the collars 114 are mounted to the lower support assembly 106. For example, angles 174 and 175 can range between 5 degrees and 20 degrees. More specifically, and in one embodiment, angles 174 and 175 are substantially identical and can be approximately 10 degrees. However, it should be realized that angles 172 and 173 as well as 174 and 175 can also be different from each other.

As illustrated in FIG. 2, angles 172 and 174 different from each other and angles 173 and 175 are different from each other. These different angles allow loose item display assembly 112 to jut forward from back panel 203 of display unit 200 and be tilted toward the viewer enough for the loose items being held in containers 116 and 117 to be better presented to the viewer. In addition, angles 128 and 138 (i.e., the relative angled orientation between upper surfaces of the crossbars 108 and 110 and upper surfaces 124 and 134 of arms 109 and 111) are different from angles 172, 173, 174 and 175. Angles 128 and 138 allow loose item display assemblies to better fit on crossbars 108 and 110 without falling off. Still further, angle 158 (i.e., the relative angled orientation between front face 154 of sign holder 140 and upper surface 145 of collar 114) is different from angles 172, 173, 174, 175, 128 and 138. Angle 158 allows the product price being held by sign holder 140 to be better oriented for ease of viewing by the viewer.

To display loose items in a retail store, either upper support assembly 104 and/or lower support assembly 106 are mounted to a pair of uprights on a display unit. More particularly, distal ends of a pair of arms on upper support assembly 104 and/or lower support assembly 106 are directly attached to the uprights on the display unit. One or more loose item display assemblies 112 are mounted to crossbar 108 of upper support assembly 104 and one or more loose item display assemblies 113 are mounted to crossbar 110 of lower support assembly 106. To mount loose item display assemblies 112 and 113, collar 114 is clipped to crossbar 108 in the case of loose item display assembly 112 and clipped to crossbar 110 in the case of loose item display assembly 113 using mounting bracket 118. In this way, an upper surface 145 of collar 114 is oriented at an angle from upper surface 124 of the pair of upper arms 109 of upper support assembly 104 and from upper surface 134 of lower support assembly 106. Container 116 is inserted into central opening 146 of collar 114 in the case of loose item display assembly 112 and container 117 is inserted into central opening 146 of collar 114 in the case of loose item display assembly 113. Containers 116 and 117 are configured to hold loose items for display.

To clip collar 114 to crossbar 108 or crossbar 110, saddle 146 on mounting bracket 118 that extends between distal downwardly depending clip member 148 and proximal downwardly depending clip member 150 engages with upper surface 126 of crossbar 108 or crossbar 110. Fastener 152, such as a screw and wing nut, are inserted through proximal downwardly depending clip member 150 to thereby extend underneath the crossbar. Fastener 152 provides added integrity to the display fixture 100 as mounted to display unit 200 by preventing distal clip 144 from being pushed up and off the crossbar.

In addition, a marketing sign can be received by each sign holder 140 so as to display the product price of loose items located in container 116 or container 117 of the display fixture. The marketing sign can be affixed, inserted, or otherwise retained by sign holder so that the product price is easily viewed.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a support assembly mounted to a pair of uprights on a display unit and including a pair of arms and a crossbar, wherein distal ends of the pair of arms directly attach to the uprights on the display unit and the crossbar extends between proximal ends of the pair of arms;

at least one loose item display assembly mounted to the crossbar of the support assembly, each of the loose item display assemblies comprising:

a collar having an inner diameter that defines a central opening, wherein the central opening of the collar is configured to receive and retain a container for holding loose items for display; and a mounting bracket fixedly attached to a back of the collar at a proximal end and removably coupled to the crossbar of the support assembly; and a sign holder directly attached to a front of the collar and having a front face;

wherein upper surfaces of the pair of arms of the support assembly are oriented at a first angle relative to the pair of uprights and an upper surface of the collar is oriented at a second angle relative to the upper surfaces of the pair of arms, the first angle being different from the second angle.

2. The display fixture of claim 1, wherein an upper surface of the crossbar is oriented at a third angle relative to the upper surfaces of the pair of arms, the third angle being different from the first angle and the second angle.

3. The display fixture of claim 1, wherein the support assembly is an upper support assembly, the pair of arms are a pair of upper arms and the crossbar is an upper crossbar, wherein the display fixture further comprises a lower support assembly mounted to the pair of uprights on the display unit below the upper support assembly and including a pair of lower arms and a lower crossbar, wherein distal ends of the pair of lower arms directly attach to the uprights on the display unit and the lower crossbar extends between proximal ends of the pair of lower arms.

4. The display fixture of claim 1, wherein the mounting bracket is fixedly attached to the back of the collar at the proximal end and removably coupled to the crossbar of the support assembly with a distal clip, the distal clip comprising a saddle extending between a distal downwardly depending clip member and a proximal downwardly depending clip member, the saddle contacting the upper surface of the crossbar and a fastener inserted through the proximal downwardly depending clip member engaging with the crossbar.

5. The display fixture of claim 1, wherein the front face of the sign holder is oriented at a third angle relative to the upper surface of the collar, the third angle being different from the first angle and the second angle.

6. A retail display comprising:

an upper member mounted to a wall and extending a first distance from the wall;

a lower member mounted to the wall below the upper member and extending a second distance from the wall that is greater than the first distance;

one or more receptacles supporting loose items for display, each of the one or more receptacles comprising:

a main body having a first outer diameter; and an upper body having a second outer diameter that is greater than the first outer diameter of the main body such that a space between the first outer diameter of the main body and the second diameter of the upper body forms a peripheral shoulder;

one or more rings removably coupled to the upper member by a first mounting bracket and one or more rings removably coupled to the lower member by a second mounting bracket, each of the one or more rings configured to receive one of the receptacles such that the peripheral shoulder of each receptacle rests on an upper surface of the ring; and a sign holder directly attached to a front of each of the one or more rings and having a front face.

7. The display fixture of claim 6, wherein the upper member is mounted to and extends from the wall by a pair of upper struts having upper surfaces that are oriented at a first angle relative to the wall, wherein an upper surface of the one or more rings that are removably coupled to the upper member is oriented at a second angle relative to the upper surfaces of the pair of upper struts, the first angle being different from the second angle.

8. The display fixture of claim 7, wherein the lower member is mounted to and extends from the wall by a pair of lower struts having upper surfaces that are oriented at a third angle relative to the wall, wherein an upper surface of the one or more rings that are removably coupled to the lower member is oriented at a fourth angle relative to the upper surfaces of the pair of lower struts, the third angle being different from the fourth angle.

9. The display fixture of claim 8, wherein the first angle and the third angle are substantially identical.

10. The display fixture of claim 8, wherein an upper surface of the upper member is oriented at a fifth angle relative to the upper surfaces of the pair of upper struts and wherein an upper surface of the lower member is oriented at a sixth angle relative to the upper surfaces of the pair of lower struts.

11. The display fixture of claim 10, wherein the fifth angle and the sixth angle are substantially identical.

12. The display fixture of claim 7, wherein the front face of the sign holder is oriented at a third angle relative to the upper surface of the one or more rings, the third angle being different from the first angle and the second angle.

13. A method of displaying loose items in a retail store, the method comprising:

mounting a support assembly to a pair of uprights on a display unit, the support assembly comprising:

a pair of arms having distal ends directly attached to the uprights on the display unit, wherein upper surfaces of the pair of arms are oriented at a first angle relative to the pair of uprights;

a crossbar extending between proximal ends of the pair of arms;

mounting at least one loose item display assembly to the crossbar of the support assembly by:

clipping a removable collar to the crossbar of the support assembly with a mounting bracket fixedly attached to the collar at a proximal end such that an upper surface of the collar is oriented at a second angle from upper surface of the pair of arms of the support assembly, the first angle and the second angle being different, wherein clipping the removable collar to the crossbar of the support assembly with the mounting bracket comprises engaging a saddle extending between a distal downwardly depending clip member and a proximal downwardly depending clip member with an upper surface of the crossbar and engaging a fastener inserted through the proximal downwardly depending clip member with a surface of the crossbar, wherein the saddle is coupled to the collar via two parallel spacing members each separately fixedly attached to the collar at the proximal end, the two parallel spacing members are fixedly coupled to the saddle at a distal end to maintain the collar in front of the saddle such that an open space is defined between the collar and the saddle, and the open space is bordered by each of the two parallel spacing members; and inserting a container configured to hold loose items into a central opening of the collar that is defined by an inner diameter of the collar.

14. The method of claim 13, further comprising directly mounting a sign holder to a front of the collar, the sign holder having a front face that is oriented at a third angle relative to a side surface of the collar, the third angle being different from the first angle and the second angle.

15. The display fixture of claim 1, wherein the collar consists solely of an annular ring.

16. The display fixture of claim 4, wherein the mounting bracket includes two parallel spacing members each fixedly attached to the back of the collar and spaced from each other such that each of the spacing members is statically positioned relative to and rearwardly extends from the collar, and the distal clip is fixedly attached to each of the spacing members opposite the collar such that the distal clip is maintained in a static position relative to each of the collar and the spacing members.

17. The display fixture of claim 1, wherein:

the pair of arms is a first pair of arms, the crossbar is a first crossbar, the collar is a first collar, the mounting bracket is a first mounting bracket, the support assembly includes a second pair of arms directly attached to the uprights on the display unit and extending forwardly from the uprights a distance farther than the first pair of arms extends from the uprights, the support assembly includes a second crossbar extending between proximal ends of the second pair of arms such that the second crossbar extends in front of the first cross bar, the at least one loose item display assembly includes a second collar and a second mounting bracket, and wherein the second angle of the upper surface of the first collar is configured to retain the container at a downwardly and rearwardly extending angle in order to avoid obstructing access to the second collar.

18. The display fixture of claim 16, wherein the sign holder is statically secured to the front of the collar at each of opposing ends of the sign holder, and the sign holder is positioned entirely below the upper surface of the collar.

* * * * *